US010114319B1

(12) United States Patent
Kawashima

(10) Patent No.: US 10,114,319 B1
(45) Date of Patent: Oct. 30, 2018

(54) FIXING APPARATUS WITH COIL AND MOVABLE MAGNETIC BODY AND IMAGE FORMING APPARATUS WITH COIL AND MOVABLE MAGNETIC BODY

(71) Applicants: KABUSHIKI KAISHA TOSHIBA, Tokyo (JP); TOSHIBA TEC KABUSHIKI KAISHA, Tokyo (JP)

(72) Inventor: Yuki Kawashima, Kannami Tagata Shizuoka (JP)

(73) Assignees: KABUSHIKI KAISHA TOSHIBA, Tokyo (JP); TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/706,436

(22) Filed: Sep. 15, 2017

(51) Int. Cl.
*G03G 15/20* (2006.01)
*G03G 9/087* (2006.01)

(52) U.S. Cl.
CPC ..... *G03G 15/2053* (2013.01); *G03G 9/08766* (2013.01); *G03G 15/2039* (2013.01); *G03G 2215/2003* (2013.01)

(58) Field of Classification Search
CPC ..... G03G 15/2053
USPC ..... 399/320
See application file for complete search history.

(56) References Cited

U.S. PATENT DOCUMENTS 9,057,993 B2 6/2015 Takeuchi et al.

FOREIGN PATENT DOCUMENTS

| | | | |
|---|---|---|---|
| JP | 2003-084587 A | | 3/2003 |
| JP | 2003308957 A | * | 10/2003 |
| JP | 2009003048 A | * | 1/2009 |
| JP | 2009300549 A | * | 12/2009 |
| JP | 2013-054114 A | | 3/2013 |

* cited by examiner

*Primary Examiner* — Quana M Grainger
(74) *Attorney, Agent, or Firm* — Foley & Lardner LLP

(57) ABSTRACT

A fixing apparatus includes a fixing belt and an induced current generation section. The fixing belt includes a conductive layer. The induced current generation section faces the fixing belt. The induced current generation section includes a coil and a magnetic body. The coil generates a magnetic flux. The magnetic body faces the fixing belt across the coil. In the magnetic body, a part facing an end in a width direction of the fixing belt is set as a movable magnetic body capable of moving in a width direction.

16 Claims, 4 Drawing Sheets

FIXING APPARATUS WITH COIL AND MOVABLE MAGNETIC BODY AND IMAGE FORMING APPARATUS WITH COIL AND MOVABLE MAGNETIC BODY

FIELD

The present disclosure relates generally to a fixing apparatus and an image forming apparatus.

BACKGROUND

There is an image forming apparatus for forming an image on a sheet while conveying a sheet-like image receiving medium such as paper (hereinafter, collectively referred to as a "sheet"). The image forming apparatus includes a fixing apparatus. For example, in the fixing apparatus, a conductive layer of a fixing belt is heated by an electromagnetic induction heating system (hereinafter referred to as "IH system"). The fixing apparatus fixes a toner image on the sheet by the heat of the fixing belt.

The fixing apparatus includes an electromagnetic induction heating device for heating the fixing belt. The electromagnetic induction heating device generates magnetic flux by applying a high frequency current from an inverter driving circuit. The electromagnetic induction heating device includes a coil and a ferrite core (magnetic body). The ferrite core covers a side opposite to the fixing belt of the coil (hereinafter referred to as "rear surface side"). The ferrite core concentrates the magnetic flux from the coil on the fixing belt. The ferrite core enables opposite parts of the fixing belt to generate heat.

DETAILED DESCRIPTION

Figure 1:
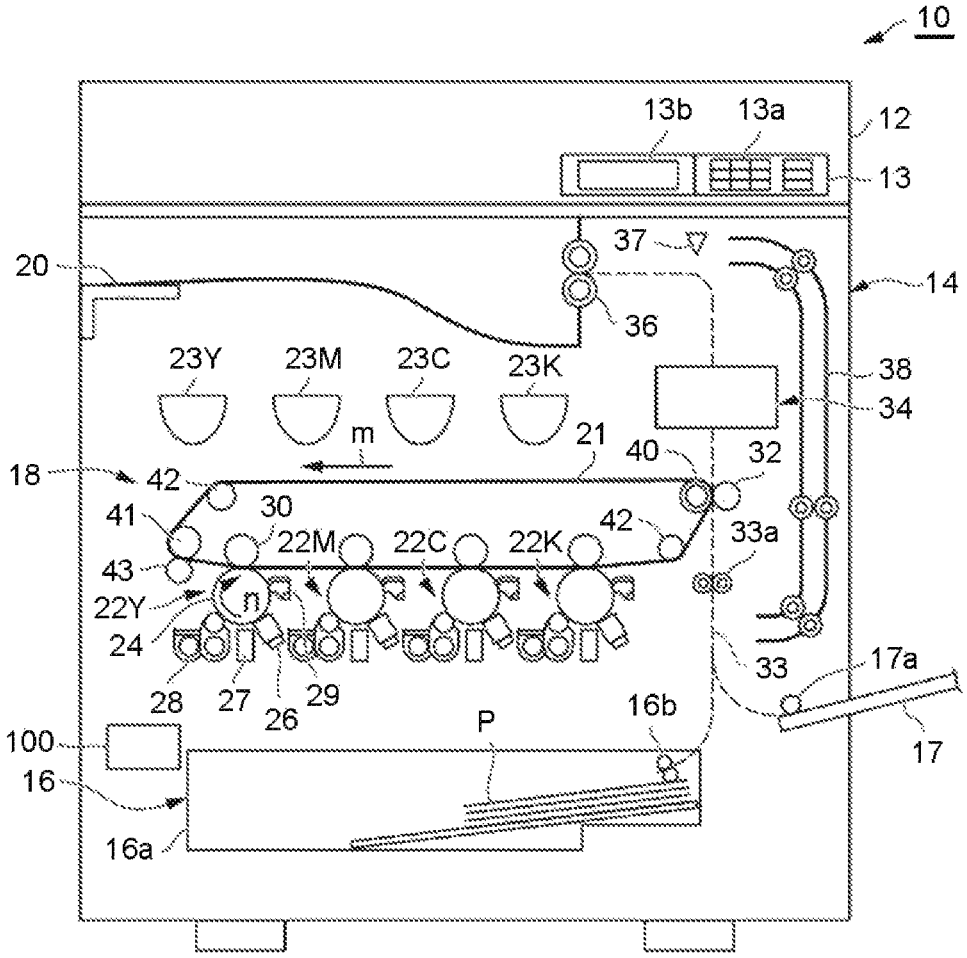
FIG. 1 is a side view of an image forming apparatus according to an embodiment.

Depending on the size of the sheet, a fixing apparatus produces a sheet passing area through which the sheet passes and a non-sheet passing area through which the sheet does not pass. The sheet passing area of the fixing apparatus applies the heat generated by the fixing belt to the sheet. The non-sheet passing area of the fixing apparatus cannot apply the heat generated by the fixing belt to the sheet, and there is a possibility of temperature rise.

The non-sheet passing area of the fixing apparatus exists at an end in a width direction orthogonal to a sheet conveyance direction in the fixing belt. For example, the fixing apparatus uses a temperature-sensitive magnetic alloy for a magnetic path as a method for preventing the temperature rise at the end in the width direction of the fixing belt. If the temperature-sensitive magnetic alloy exceeds a set Curie temperature, the magnetism disappears and the heat generation of the fixing belt is weakened. However, the temperature-sensitive magnetic alloy has variation in the Curie temperature, and it is difficult to manage the temperature at the end in the width direction of the fixing belt.

In accordance with an embodiment, a fixing apparatus comprises a fixing belt and an induced current generation section. The fixing belt includes a conductive layer. The induced current generation section faces the fixing belt. The induced current generation section includes a coil and a magnetic body. The coil generates a magnetic flux. The magnetic body faces the fixing belt across the coil. In the magnetic body, a part facing an end in a width direction of the fixing belt is set as a movable magnetic body capable of moving in a width direction.

Hereinafter, an image forming apparatus and a fixing apparatus of at least one embodiment is described with reference to the accompanying drawings. Further, in each figure, the same components are given the same reference numerals.

FIG. 1 is a side view of the image forming apparatus according to the embodiment. Hereinafter, a multifunction printer (MFP) 10 is described as an example of an image forming apparatus.

As shown in FIG. 1, the MFP 10 is provided with a scanner 12, a control panel 13 and a main body section 14. The scanner 12, the control panel 13 and the main body section 14 are respectively provided with a controller. The MFP 10 is provided with a system controller 100 for collectively controlling the controllers. The system controller 100 includes a CPU (Central Processing Unit), a ROM (Read Only Memory) and a RAM (Random Access Memory) (not shown).

The system controller 100 controls a main body control circuit 101 (refer to FIG. 2) serving as a controller of the main body section 14. The main body control circuit 101 is provided with a CPU, a ROM and a RAM (not shown). The main body section 14 is provided with a sheet feed cassette section 16, a manual sheet feed tray 17, a printer section 18 and a sheet discharge section 20. The main body control circuit 101 controls the sheet feed cassette section 16, the printer section 18 and a fixing apparatus 34 described later.

The scanner 12 reads a document image. The control panel 13 is provided with an input key 13*a* and a display section 13*b*. For example, the input key 13*a* receives an input by a user. For example, the display section 13*b* is a touch panel type. The display section 13*b* receives the input by the user to display it to the user.

The sheet feed cassette section 16 is provided with a sheet feed cassette 16*a* and a pickup roller 16*b*. The sheet feed cassette 16*a* houses a sheet P serving as an image receiving medium. The pickup roller 16*b* takes out the sheet P from the sheet feed cassette 16*a*. The sheet feed cassette 16*a* feeds an unused or reused sheet P. The manual sheet feed tray 17 feeds an unused or reused sheet P through a pickup roller 17*a*. For example, the reused sheet P is obtained by decolorizing an image through a decoloring processing.

The printer section 18 is used to form an image. For example, the printer section 18 forms an image of the document image read by the scanner 12. The printer section 18 is provided with an intermediate transfer belt 21. The printer section 18 supports the intermediate transfer belt 21 with a backup roller 40, a driven roller 41 and a tension roller 42. The backup roller 40 is provided with a driving section (not shown). The printer section 18 rotates the intermediate transfer belt 21 in an arrow m direction.

The printer section 18 is provided with four sets of image forming stations including the image forming stations 22Y, 22M, 22C and 22K. The image forming stations 22Y, 22M, 22C and 22K are respectively used to form a Y (yellow) image, an M (magenta) image, a C (cyan) image and a K (black) image. The image forming stations 22Y, 22M, 22C and 22K, positioned at the lower side of the intermediate transfer belt 21, are arranged in parallel along a rotation direction of the intermediate transfer belt 21.

The printer section 18 is provided with cartridges 23Y, 23M, 23C and 23K above the image forming stations 22Y, 22M, 22C and 22K correspondingly. The cartridges 23Y, 23M, 23C and 23K are used to house Y (yellow) toner, M (magenta) toner, C (cyan) toner and K (black) toner for replenishment.

Hereinafter, among the image forming stations 22Y, 22M, 22C and 22K, the image forming station 22Y of Y (yellow) is described as an example. Further, as the image forming stations 22M, 22C and 22K have the same configuration as the image forming station 22Y, the detailed description thereof is omitted.

The image forming station 22Y is provided with a charging charger 26, an exposure scanning head 27, a developing device 28 and a photoconductor cleaner 29. The charging charger 26, the exposure scanning head 27, the developing device 28 and the photoconductor cleaner 29 are arranged around a photoconductive drum 24 which rotates in an arrow n direction.

The image forming station 22Y is provided with a primary transfer roller 30. The primary transfer roller 30 faces the photoconductive drum 24 across the intermediate transfer belt 21.

After charging the photoconductive drum 24 with the charging charger 26, the image forming station 22Y exposes the photoconductive drum 24 with the exposure scanning head 27. The image forming station 22Y forms an electrostatic latent image on the photoconductive drum 24. The developing device 28 develops the electrostatic latent image on the photoconductive drum 24 with a two-component developing agent formed by toner and a carrier. For example, the toner used for development is non-decoloring toner or decoloring toner. For example, the decoloring toner can be decolorized by being heated to a predetermined decoloring temperature or higher.

The primary transfer roller 30 primarily transfers a toner image formed on the photoconductive drum 24 onto the intermediate transfer belt 21. The image forming stations 22Y, 22M, 22C and 22K form a color toner image on the intermediate transfer belt 21 with the primary transfer roller 30. The color toner image is formed by overlapping the Y (yellow) toner image, the M (magenta) toner image, the C (cyan) toner image and the K (black) toner image in order. The photoconductor cleaner 29 removes the toner left on the photoconductive drum 24 after the primary transfer.

The printer section 18 is provided with a secondary transfer roller 32. The secondary transfer roller 32 faces a backup roller 40 across the intermediate transfer belt 21. The secondary transfer roller 32 secondarily transfers the color toner image on the intermediate transfer belt 21 collectively onto the sheet P. The sheet P is fed from the sheet feed cassette section 16 or the manual sheet feed tray 17 along a conveyance path 33.

The printer section 18 is provided with a belt cleaner 43 facing the driven roller 41 across the intermediate transfer belt 21. The belt cleaner 43 is used to remove the toner left on the intermediate transfer belt 21 after the secondary transfer. The intermediate transfer belt 21, four sets of image forming stations 22Y, 22M, 22C and 22K, and the secondary transfer roller 32 form an image forming section.

The printer section 18 is provided with a resist roller 33*a*, the fixing apparatus 34 and a sheet discharge roller 36 along the conveyance path 33. The printer section 18 is provided with a bifurcating section 37 and a reverse conveyance section 38 at the downstream side of the fixing apparatus 34. The bifurcating section 37 sends the sheet P after a fixing processing to the sheet discharge section 20 or the reverse conveyance section 38. In a case of duplex printing, the reverse conveyance section 38 reverses the sheet P sent from the bifurcating section 37 to the direction of the resist roller 33*a* to convey the sheet P. The MFP 10 forms a fixed toner image on the sheet P with the printer section 18 to discharge the sheet P to the sheet discharge section 20.

Hereinafter, the fixing apparatus 34 is described in detail.

Figure 2:
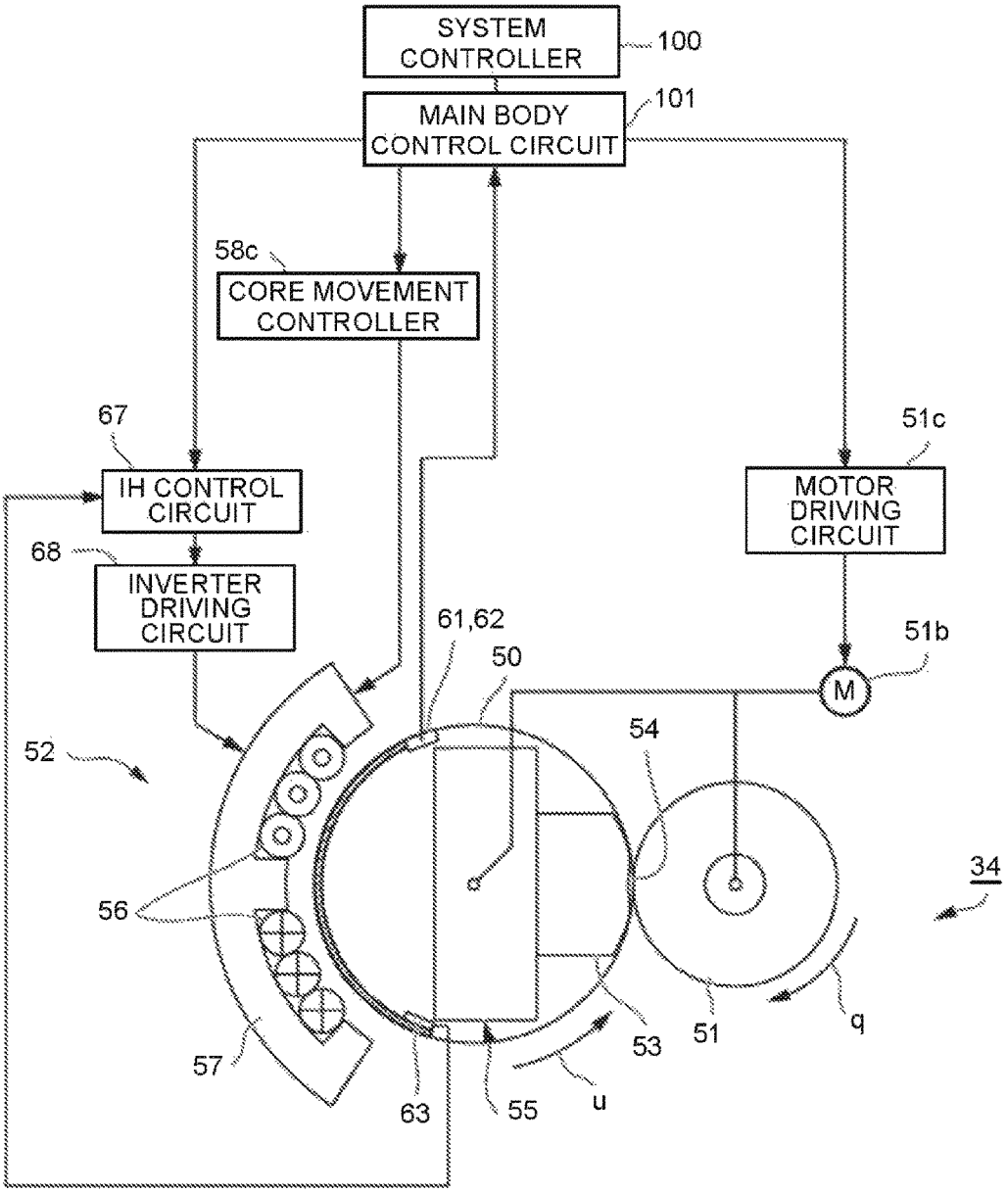
FIG. 2 is a side view illustrating control blocks of a fixing apparatus and a main body control circuit according to the embodiment.

FIG. 2 is a side view containing control blocks of the fixing apparatus 34 and the main body control circuit 101 (controller) according to the embodiment.

As shown in FIG. 2, the fixing apparatus 34 is provided with a fixing belt 50, a press roller 51, an electromagnetic induction heating coil unit 52 (induced current generation section, electromagnetic induction heating device) and the main body control circuit 101. Hereinafter, the electromagnetic induction heating coil unit is referred to as an "IH coil unit".

For example, the fixing belt 50 is a cylindrical endless belt. In the inner peripheral side of the fixing belt 50, a belt inside mechanism 55 containing a nip pad 53 is arranged. The nip pad 53 is supported in the belt inner mechanism 55 on the inner peripheral side of the fixing belt 50.

The fixing belt 50 is formed by overlapping a heat generation layer (conductive layer) serving as a heat generation section on a base layer. For example, the base layer is formed by polyimide resin (PI). For example, the heat generation layer is formed by nickel (Ni), iron (Fe), stainless steel, aluminum (Al), copper (Cu) and silver (Ag). The heat generation layer generates an eddy current by the magnetic flux generated by the IH coil unit 52. The heat generation layer generates Joule heat by the eddy current and a resistance value of the heat generation layer to heat the fixing belt 50.

The fixing belt 50 makes the heat generation layer thin to reduce a heat capacity thereof in order to rapidly be warmed up. The fixing belt 50 with a small heat capacity can shorten the time required for warming-up to save consumption of energy.

The nip pad 53 presses the inner peripheral surface of the fixing belt 50 toward the press roller 51 side. The nip pad 53 forms a nip 54 between the fixing belt 50 and the press roller 51. For example, the nip pad 53 is formed of an elastic material such as silicone rubber and fluororubber.

For example, a seat or a release layer with good sliding property and good abrasion resistance is interposed between the fixing belt 50 and the nip pad 53. The frictional resistance between the fixing belt 50 and the nip pad 53 is reduced by the sheet or the release layer.

For example, the press roller 51 is provided with an elastic layer such as a silicone sponge layer and a silicone rubber layer having heat-resistance around a core metal thereof. For example, the release layer such as fluororesin layer is arranged on the surface of the press roller 51. The press roller 51 pressurizes the fixing belt 50 towards the nip pad 53.

As a driving source of the fixing belt 50 and the press roller 51, one motor 51*b* (driving section) is arranged. The motor 51*b* is driven by a motor driving circuit 51*c* controlled by the main body control circuit 101. The motor 51*b* is connected with the press roller 51 via a first gear train (not shown). The motor 51*b* is connected with a belt driving member via a second gear train and a one-way clutch (not shown). The press roller 51 rotates in an arrow q direction through the motor 51*b*. At the time the fixing belt 50 abuts against the press roller 51, the fixing belt 50 is driven by the press roller 51 to rotate in an arrow u direction. At the time of the separation of the fixing belt 50 and the press roller 51, the fixing belt 50 rotates in the arrow u direction by the motor 51*b*. Further, the fixing belt 50 may be independent of the press roller 51 and have a driving source thereof.

At the inner peripheral side of the fixing belt 50, a center thermistor 61 and an edge thermistor 62 are arranged. The center thermistor 61 and the edge thermistor 62 are used to measure the belt temperature. The measurement result of the belt temperature is input to the main body control circuit 101. The center thermistor 61 is arranged at the inner side of the belt width direction. The edge thermistor 62 is arranged in the heating area of the IH coil unit 52 and the non-sheet passing area in the belt width direction. The main body control circuit 101 stops the output of the electromagnetic induction heating if the belt temperature measured by the edge thermistor 62 is equal to or greater than a threshold value. By stopping the output of the electromagnetic induction heating if the temperature of the non-sheet passing area of the fixing belt 50 excessively rises, the damage of the fixing belt 50 is prevented.

The main body control circuit 101 controls an IH control circuit 67 according to the measurement result of the belt temperature by the center thermistor 61 and the edge thermistor 62. The IH control circuit 67 controls a magnitude of a high frequency current output by an inverter driving circuit 68 under the control of the main body control circuit 101. The temperature of the fixing belt 50 is maintained in various control temperature ranges according to the output by the inverter driving circuit 68. The IH control circuit 67 is provided with a CPU, a ROM and a RAM (none is shown).

For example, a thermostat 63 is arranged in the belt inside mechanism 55. The thermostat 63 functions as a safety device of the fixing apparatus 34. The thermostat 63 operates if the fixing belt 50 abnormally generates heat and the temperature thereof rises to a cut-off threshold value. Through the operation of the thermostat 63, the current to the IH coil unit 52 is cut off. By cutting off the current to the IH coil unit 52, the abnormal heat generation of the fixing apparatus 34 can be prevented.

The IH coil unit 52 is arranged at the outer peripheral side of the fixing belt 50. The IH coil unit 52 includes a coil 56 and a ferrite core (magnetic body) 57.

The coil 56 faces the fixing belt 50 from the outer peripheral side. For example, the coil 56 uses Litz wire. The Litz wire is formed by bundling a plurality of copper wires coated with a heat-resistant polyamide-imide which is an insulating material. The coil 56 is formed by winding a conductive winding for a plurality of circles.

A high frequency current is applied to the coil 56 from the inverter driving circuit 68. The high frequency current flows in the coil 56, thereby generating a high frequency magnetic field around the coil 56. Through the magnetic flux of the high frequency magnetic field, an eddy current is generated in the heat generation layer of the fixing belt 50. Through the electric resistance of the eddy current and the heat generation layer, Joule heat is generated in the heat generation layer. Through the generation of the Joule heat, the fixing belt 50 is heated. The IH control circuit 67 controls the magnitude of the high frequency current output by the inverter driving circuit 68. The control of the inverter driving circuit 68 is performed according to the detection results of the center thermistor 61 and the edge thermistor 62.

The ferrite core 57 is positioned at the opposite side (hereinafter referred to as "rear surface side") to the fixing belt 50 of the coil 56. For example, the ferrite core 57 is formed of a magnetic material such as a nickel-zinc alloy (Ni—Zn) or a manganese-nickel alloy (Mn—Ni).

The ferrite core 57 prevents the magnetic flux generated by the coil 56 from leaking in a rear surface direction. The ferrite core 57 concentrates the magnetic flux from the coil 56 on the fixing belt 50. The ferrite core 57 enables the opposite part of the fixing belt 50 to generate the heat.

The ferrite core 57 is made by arranging a plurality of unit cores 57*a* in the width direction. The magnetic flux generated by the coil 56 concentrates on the fixing belt 50 including each unit core 57*a* in the magnetic path. In the fixing belt 50, a part facing each unit core 57*a* mainly generates the heat.

The IH coil unit 52 generates an induced current in the heat generation layer of the fixing belt 50 facing the IH coil unit 52 while the fixing belt 50 rotates in the arrow u direction.

Figure 4:
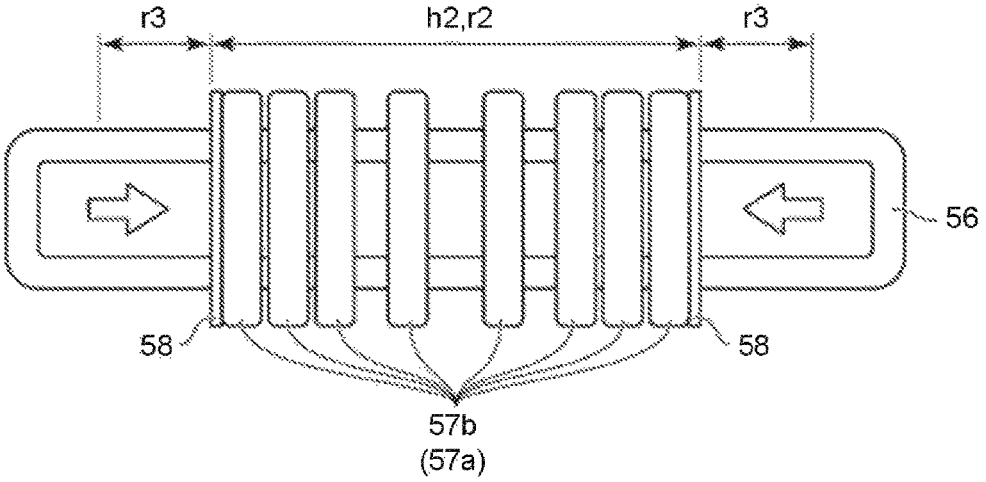
FIG. 4 is a plan view illustrating the function of the IH coil unit according to an embodiment.

As shown in FIG. 4, in the fixing apparatus 34, a sheet passing area r2 through which the sheet P passes and a non-sheet passing area r3 through which the sheet P does not pass are formed depending on the size of the sheet P. The sheet passing area r2 of the fixing apparatus 34 applies the heat generated by the fixing belt 50 to the sheet P. The non-sheet passing area r3 of the fixing apparatus 34 cannot apply the heat generated by the fixing belt 50 to the sheet P, and there is a possibility of rising in the temperature. The fixing apparatus 34 conveys the sheet P with the center of the width direction of the sheet P matching the center of the width direction of the fixing belt 50. If the sheet P has small width, the non-sheet passing area r3 occurs at both ends in the width direction of the fixing belt 50.

In the present embodiment, the unit core 57*a* of the ferrite core 57 is moved in the width direction in order to prevent the temperature of both ends in the width direction (the non-sheet passing area r3) of the fixing belt 50 from rising. In the part that does not face the unit core 57*a* of the fixing belt 50, the magnetic flux does not concentrate. The part that does not face the unit core 57*a* of the fixing belt 50 weakens the heat generation.

Since the sheet P is deprived of the heat in the sheet passing area r2 of the fixing belt 50, in order to maintain the fixing temperature, the unit core 57*a* is disposed to ensure a calorific value. Since the sheet P is not deprived of the heat in the non-sheet passing area r3 of the fixing belt 50, in order to suppress the temperature rise of the fixing belt 50, the unit core 57*a* is not disposed to lower the calorific value. In the example in FIG. 4, the unit core 57*a* at the outside in the width direction retreats to the inside in the width direction. In the configuration in which the unit core 57*a* retreats in the width direction, the effect of suppressing the temperature rise of the fixing belt 50 is higher than that in the configuration in which the unit core 57*a* retreats in a direction crossing (orthogonal) to the width direction.

Figure 3:
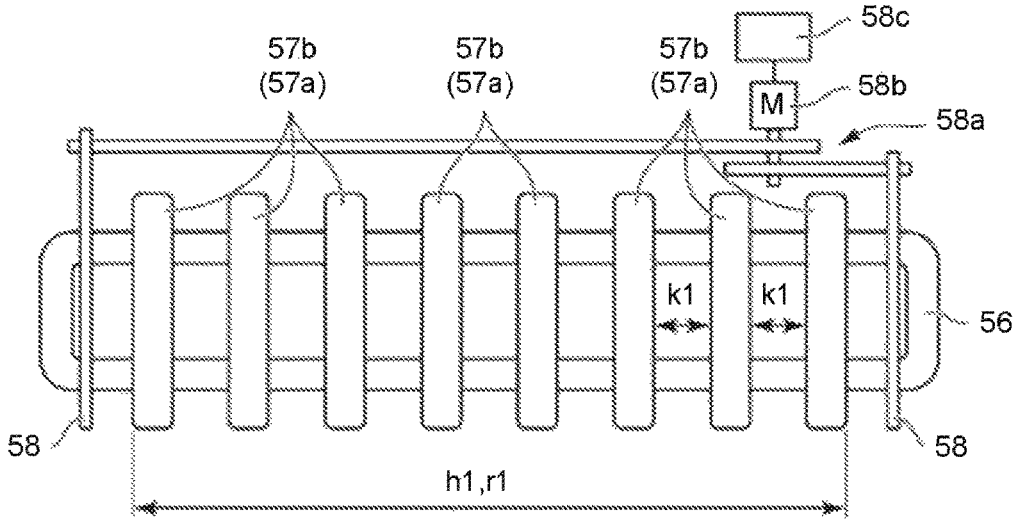
FIG. 3 is a plan view of an IH coil unit of the fixing apparatus according to an embodiment.

As shown in FIG. 3, the ferrite core 57 is divided into a plurality of the unit cores 57*a* movable along the width direction (longitudinal direction of the coil 56). The ferrite core 57 has a first width h1 in the width direction at the time the sheet P with a maximum width passing through the fixing apparatus 34. If the ferrite core 57 has the first width h1, the plurality of the unit cores 57*a* is equally spaced apart by a first interval k1 between the adjacent unit cores 57*a* in the width direction. At this time, the positions of the plurality of the unit cores 57*a* are set as positions before movement or initial positions. For example, the first width h1 of the ferrite core 57 is the width of the sheet P with the largest width of the short side thereof among the sheets P to be fed. For example, the first width h1 is slightly larger than the short side width of an A3 paper. For example, the first width h1 is the full width of the fixing belt 50, which is a sheet passing area r1. If the sheet passing area r1 is ensured, there is no non-sheet passing area practically.

As shown in FIG. 4, the ferrite core 57 shortens the full width of the ferrite core 57 according to the size of the sheet P at the time the sheet P having a width smaller than the maximum width passes through the fixing apparatus 34. For the example, the plurality of the unit cores 57*a* forming the ferrite core 57 is set as movable cores 57*b* capable of moving in the width direction. The unit cores 57*a* (the movable cores 57*b*) positioned at both ends in the width direction of the ferrite core 57 face the both sides in the width direction of the fixing belt 50. The ferrite core 57 shortens the whole width by moving the unit cores 57*a* (movable cores 57*b*) positioned at both ends in the width direction towards the inside in the width direction thereof. At this time, the ferrite core 57 has a second width h2 in the width direction. For example, the second width h2 is slightly larger than the short side width of A4 paper. For example, the second width h2 is the sheet passing area r2. If the sheet passing area r2 is ensured, the non-sheet passing area r3 is generated.

At both external sides in the width direction of the ferrite core 57, sidewalls 58 movable in the width direction are arranged. The unit cores 57*a* positioned at both ends in the width direction of the ferrite core 57 are moved by being pressed towards the inside in the width direction thereof by the movement of the two sidewalls 58. For example, the two sidewalls 58 are driven by the motor 58*b* as a driving source and are moved at both sides in the width direction by a moving mechanism 58*a* such as a rack and pinion. The driving of the motor 58*b* is controlled by a core movement controller 58*c* connected to the main body control circuit 101.

By changing the positions in the width direction of the unit cores 57*a* forming the ferrite core 57, the heating area of the fixing belt 50 changes. As the heat can easily escape towards the outside in the width direction, it is desired that the amount of generated heat is increased by arranging more unit cores 57*a* at the end of the sheet passing area r2. The sidewall 58 sequentially approaches the inside in the width direction from the unit core 57*a* at the outside in the width direction by moving inward in the width direction. Therefore, the unit cores 57*a* tend to gather at the outside in the width direction of the sheet passing area r2, and the unit cores 57*a* suitable for heating the sheet passing area r2 are moved.

For example, the core movement controller 58*c* drives the two sidewalls 58 according to the size of the sheet P conveyed by the fixing belt 50. The two sidewalls 58 move the unit core 57*a* at the outermost side in the width direction of the ferrite core 57 to the inside in the width direction thereof. In this way, the total width of the ferrite core 57 is reduced in accordance with the sheet size. At this time, the unit cores 57*a* retreat in the width direction from the part opposite to the non-sheet passing area r3 at both sides in the width direction of the fixing belt 50. If the unit cores 57*a* retreat, the occurrence of the magnetic flux is suppressed and the heat generation is weakened, so that an increase in the end temperature of the fixing belt 50 is suppressed. The unit core 57*a* at the outermost side in the width direction contributes to heat generation at the end of the sheet passing area r2, and such heat can easily be dissipated in the fixing belt 50 at the time of moving to the inside in the width direction. As a result, the fixing belt 50 is efficiently heated and power consumption is also suppressed.

For example, the core movement controller 58*c* may drive the two sidewalls 58 according to the end temperature of the fixing belt 50. The core movement controller 58*c* may drive the two sidewalls 58 according to detection information of the edge thermistor 62. Since the unit cores 57*a* retreat according to the temperature of both ends in the width direction of the fixing belt 50 (the non-sheet passing area r3), a temperature rise at both ends in the width direction of the fixing belt 50 is reliably suppressed.

The plurality of the unit cores 57*a* is pressed against the sidewall 58 to move from the position before movement (initial position) to the movement position at the inside in the width direction.

The fixing apparatus 34 includes a return member 59 for returning the plurality of the unit cores 57*a* moving to the movement position to the position before movement. The return member 59 can approach and separate from the ferrite core 57 in a direction orthogonal to the width direction. The driving of the return member 59 is controlled by the core movement controller 58*c*.

The return member 59 makes it possible to move the unit core 57*a* by the sidewall 58 while separating from the ferrite core 57.

If the return member 59 approaches the ferrite core 57, a tooth 59*a* is inserted between the adjacent unit cores 57*a* in the width direction. The return member 59 is inserted to a space (a gap between the adjacent unit cores 57*a*) adjacent to the inside in the width direction of the plurality of the unit cores 57*a* at the movement position. The return member 59 collectively returns the plurality of the unit cores 57*a* at the movement position to the position before movement.

The tooth 59*a* protrudes to the ferrite core 57 side in a direction (approaching/separating direction) orthogonal to the width direction. A plurality of the teeth 59*a* are provided at intervals corresponding to a pitch between the plurality of the unit cores 57*a* at the position before movement. The plurality of teeth 59*a* of the return member 59 is inserted to the gaps between the adjacent unit cores 57*a* in the width direction. The return member 59 defines the pitch between a plurality of the unit cores 57*a* while returning the plurality of the unit cores 57*a* to the position before movement collectively.

Figure 5:
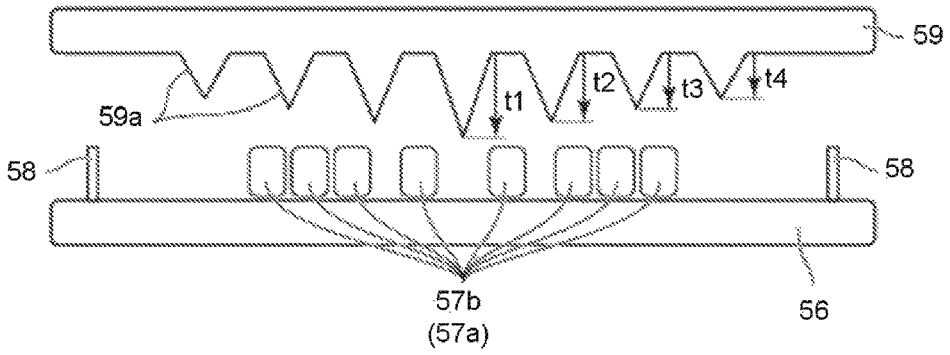
FIG. 5 is a front view illustrating a return member of the IH coil unit according to an embodiment.
Figure 6:
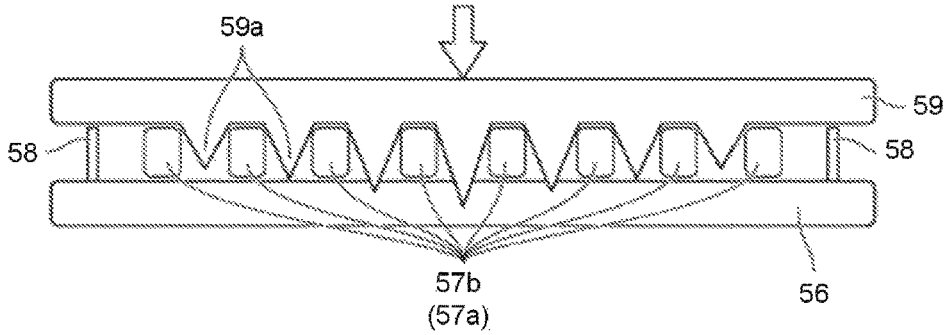
FIG. 6 is a front view illustrating the function of the return member according to an embodiment.

Each tooth 59*a* has a tapered shape tapering as it approaches the ferrite core 57. For example, the return member 59 increases the projecting height to the ferrite core 57 side as the tooth 59*a* is positioned close to the inside in the width direction. In the examples in FIG. 5 and FIG. 6, compared with a protrusion height t1 of the tooth 59*a* at the innermost side in the width direction, heights t2, t3 and t4 of the teeth 59*a* positioned at the outside in the width direction are smaller. As for the unit core 57*a*, the amount of movement to the inside in the width direction increases as the unit core 57*a* is positioned close to the outside in the width direction. The return member 59 inserts the tooth 59*a* between the adjacent unit cores 57*a* at the inside in the width direction among the plurality of the unit cores 57*a*.

Since the amount of movement of the adjacent unit cores 57*a* at the inside in the width direction is small, the tip of the tapered tooth 59*a* can be inserted. The unit core 57*a* at the inside in the width direction moves outward in the width direction, the unit core 57*a* at the outside in the width direction also moves outward in the width direction by the same amount of movement. This makes it possible to insert the tip of the tapered tooth 59*a* between the adjacent unit cores 57*a* at the outside in the width direction. By making the projecting height of the tooth 59*a* lower stepwise if the tooth 59*a* is positioned at the outside in the width direction, the tapered tooth 59*a* can be gradually inserted between the adjacent unit cores 57*a* at the outside in the width direction.

Hereinafter, the operation of the fixing apparatus 34 is described.

As shown in FIG. 2, the fixing apparatus 34 rotates the fixing belt 50 in the arrow u direction. The IH coil unit 52 generates the magnetic flux at the fixing belt 50 side by applying the high frequency current by the inverter driving circuit 68.

The IH coil unit 52 heats the fixing belt 50 by the magnetic flux including the unit core 57*a* in the magnetic path.

The IH control circuit 67 controls the inverter driving circuit 68 from the measurement result of the belt temperature by the center thermistor 61 or the edge thermistor 62. The inverter driving circuit 68 provides the high frequency current to the coil 56.

With the press roller 51 in contact with the fixing belt 50, the press roller 51 rotates in an arrow q direction, thereby driving the fixing belt 50 to rotate in the arrow u direction. If there is a print request, the MFP 10 (refer to FIG. 1) starts a printing operation. The MFP 10 forms a toner image on the sheet P with the printer section 18, and conveys the sheet P to the fixing apparatus 34.

The MFP 10 enables the sheet P on which the toner image is formed to pass through the nip 54 between the fixing belt 50 and the press roller 51. The fixing apparatus 34 fixes the toner image on the sheet P. During the fixing, the IH control circuit 67 controls the IH coil unit 52 to hold the fixing belt 50 at a fixing temperature.

By the fixing operation, the sheet passing areas r1 and r2 of the fixing belt 50 deprives the sheet P of the heat. If the sheet P has the small width, the non-sheet passing area r3 occurs at both ends in the width direction of the fixing belt 50. In order to prevent the temperature of the non-sheet passing area r3 from rising, the unit core 57*a* of the ferrite core 57 moves inward in the width direction. The unit core 57*a* is pressed by the sidewall 58 at both sides in the width direction and moves in the width direction. For example, the core movement controller 58*c* drives the two sidewalls 58 according to the size of the sheet P conveyed by the fixing belt 50 or the end temperature of the fixing belt 50. As a result, the unit core 57*a* retreats from the part facing the non-sheet passing area r3, and the heat generation in the non-sheet passing area r3 of the fixing belt 50 is suppressed.

The fixing apparatus 34 of the present embodiment includes the ferrite core 57 opposed to the fixing belt 50 across the coil 56. The ferrite core 57 defines the part opposite to the end in the width direction of the fixing belt 50 as the movable core 57*b* which can move in the width direction. This facilitates temperature management of the end in the width direction of the fixing belt 50. In other words, it is possible to retreat the movable core 57*b* from a part facing the end in the width direction of the fixing belt 50. Due to the retreat of the movable core 57*b*, the heat generation at the end in the width direction of the fixing belt 50 can be weakened. Therefore, it is possible to reliably suppress the temperature rise at the end in the width direction of the fixing belt 50.

In addition, the ferrite core 57 is divided into a plurality of the unit cores 57*a* arranged in the width direction. The plurality of the unit cores 57*a* includes a plurality of the movable cores 57*b*. By providing the plurality of the movable cores 57*b* in the width direction, it is possible to narrow the interval between the unit cores 57*a* before movement. Thereafter, the amount of movement of the unit core 57*a* of the part opposite to the end in the width direction of the fixing belt 50 can be increased. It is possible to suppress the temperature rise at the end in the width direction of the fixing belt 50, while enabling good heat generation in the whole width of the fixing belt 50.

The movable core 57*b* is provided at the end in the width direction of the ferrite core 57. At the outside in the width direction of the ferrite core 57, the sidewalls 58 movable in the width direction are provided. The movable core 57*b* positioned at the end in the width direction of the ferrite core 57 is pressed toward the inside in the width direction by the sidewalls 58 to move. This makes it easy to shorten the entire width of the ferrite core 57. The ferrite core 57 can be easily retreated from the part opposite to the end in the width direction of the fixing belt 50.

The movable core 57*b* and the sidewall 58 are provided at both sides in the width direction of the ferrite core 57. In this way, the movable cores 57*b* positioned at both sides in the width direction of the ferrite core 57 can move to the inside in the width direction thereof. In particular, in a configuration in which the sheet P is conveyed in the middle of the width direction of the fixing belt 50, both sides in the width direction of the ferrite core 57 can be contracted according to the sheet size.

The return member 59 is provided for returning the plurality of the movable cores 57*b* from the movement position after moving inward in the width direction to the position before movement. The return member 59 can approach and separate from the ferrite core 57 in the direction crossing the width direction. The return member 59 is provided with the tooth 59*a* for returning the plurality of the movable cores 57*b* to the position before movement. If the return member 59 approaches the ferrite core 57, the teeth 59*a* are inserted to positions between adjacent movable cores 57*b* at the inside in the width direction of the plurality of the movable cores 57*b* at the movement position. Thereby, after moving the plurality of the movable cores 57*b* inward in the width direction, it is possible to easily return the plurality of the movable cores 57*b* to the position before movement. It is possible to return the plurality of the movable cores 57*b* to the position before movement collectively.

The core movement controller 58*c* which controls the movement of the movable core 57*b* is also provided. For example, the core movement controller 58*c* moves the movable core 57*b* according to the size of the sheet P conveyed by the fixing belt 50. The core movement controller 58*c* controls driving of the sidewall 58 and the return member 59 according to the size of the sheet P. As a result, the arrangement of the movable cores 57*b* can be easily and reliably controlled in accordance with the sheet size. For example, at the time of conveying a large sheet P, the movable core 57*b* can be placed in a part opposite to the end in the width direction of the fixing belt 50. For example, at the time of conveying a small sheet P, the movable core 57*b* can retreat from the part opposite to the end in the width direction of the fixing belt 50.

The edge thermistor 62 is provided for detecting the temperature at the end in the width direction of the fixing belt 50. For example, the core movement controller 58*c* moves the movable core 57*b* according to the detection information of the edge thermistor 62. In other words, the core movement controller 58*c* controls the driving of the sidewall 58 and the return member 59 depending on the end temperature in the width direction of the fixing belt 50. This makes it possible to easily and reliably control the arrangement of the movable cores 57*b* in accordance with the temperature of the end in the width direction of the fixing belt 50. For example, if the temperature of the end in the width direction of the fixing belt 50 is low, the movable core 57*b* can be placed in a part opposite to the end in the width direction of the fixing belt 50. For example, if the temperature of the end in the width direction of the fixing belt 50 is high, the movable core 57*b* can retreat from the part opposite to the end in the width direction of the fixing belt 50.

The present disclosure is not limited to configurations in which the interval between the adjacent unit cores 57*a* is narrowed in order from the unit core 57*a* at both ends in the width direction. For example, the interval between the adjacent unit cores 57*a* may be narrowed at the same time in each part in the width direction.

Figure 7:
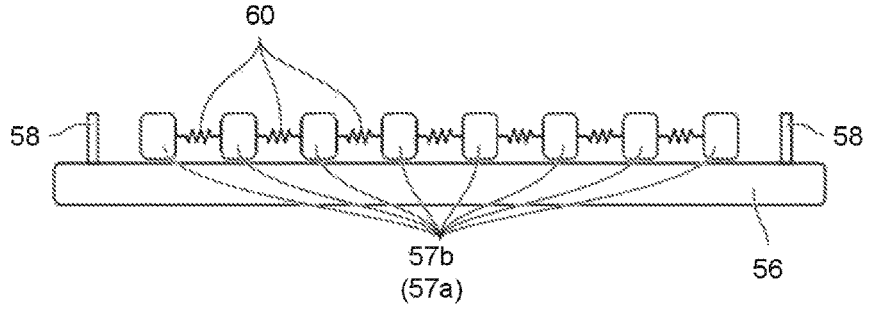
FIG. 7 is a front view illustrating a modification of the IH coil unit according to an embodiment.

As shown in FIG. 7, for example, which depicts a modified embodiment, an energization member 60 such as a coil spring is compressed in the gap between the adjacent unit cores 57*a*. The energization member 60 applies an energizing force in the opposite direction to the adjacent unit cores 57*a* in the width direction. The energization member 60 energizes the unit cores 57*a* at the outside in the width direction outward in the width direction. In this arrangement, if the unit core 57*a* positioned at the outside in the width direction is pressed by the sidewall 58 to move, the unit core 57*a* moves the adjacent unit core 57*a* via the energization member 60. As a result, the gap between the adjacent unit cores 57*a* narrows at the same time at each part in the width direction. The plurality of the unit cores 57*a* returns to the position before movement entirely by the energizing force of the energization member 60 only by releasing the pressing by the sidewall 58.

The ferrite core 57 includes a plurality of the unit cores 57*a* and a plurality of the energization members 60 at both sides sandwiching the center part of the width direction. The plurality of the unit cores 57*a* and the plurality of the energization members 60 are arranged symmetrically at both sides sandwiching the center part in the width direction of the ferrite core 57. The plurality of the energization members 60 may have the same energizing force as each other, thereby setting the plurality of the unit cores 57*a* at equal intervals. As a result, the unit cores 57*a* are uniformly dispersed in the width direction, and a bias in terms of heat generation of the fixing belt 50 is suppressed.

In the modified embodiment shown in FIG. 7, the energization member 60 is provided for energizing a plurality of the movable cores 57*b* outward in the width direction at the positions between adjacent movable cores 57*b* at the inside in the width direction of the plurality of the movable cores 57*b*. Thereby, after moving the movable core 57*b* inward in the width direction, it is possible to easily return the plurality of the movable cores 57*b* to the position before movement. By simply releasing the pressure by the sidewall 58, it is possible to return the plurality of the movable cores 57*b* to the position before movement collectively with the energizing force of the energization member 60.

The plurality of the energization members 60 may have different energizing forces from each other. The plurality of the energization members 60 make the energizing force different according to the position in the width direction of the ferrite core 57. In this case, it is possible to arrange the unit cores 57*a* at desired positions in the width direction by making the intervals among the plurality of the unit cores 57*a* unequal.

By making the energizing force of the energization member 60 different according to the position in the width direction of the ferrite core 57, the position in the width direction of the movable core 57*b* can be controlled. For example, it is possible to set that the movable cores 57*b* at the outside in the width direction are moved a lot and the movable core 57*b* at the inside in the width direction are moved less. According to the position in the width direction of the ferrite core 57, the amount of movement of the movable core 57*b* can be changed. As a result, if the plurality of the movable cores 57*b* is moved, the movable cores 57*b* can be arranged at desired positions in the width direction. Further, the position before movement of the movable core 57*b* can be arranged at a desired position in the width direction.

In each above-described embodiment, the sheet is conveyed in the middle of the width direction, but the sheet may be conveyed biased toward one side in the width direction. In this case, a movable magnetic body and a pressing member may be provided at one side of the width direction.

The magnetic body is divided into a plurality of unit magnetic bodies and all the unit magnetic bodies may be set as movable magnetic bodies capable of moving in the width direction; however, a part of the unit magnetic bodies may be set as the movable magnetic bodies while at least one remaining body is immovable. In this case, immovable unit magnetic bodies may be integrated together.

It is assumed that the movable magnetic body moves inward in the width direction; however, the movable magnetic body may move outward in the width direction.

According to at least one embodiment described above, the IH coil unit 52 of the fixing apparatus 34 has the ferrite core 57 facing the fixing belt 50 across the coil 56, and a part of the ferrite core 57 facing the end in the width direction of the fixing belt 50 is set as the movable core 57*b* movable in the width direction, and in this way, it is possible to reliably suppress the temperature rise at the end in the width direction of the fixing belt 50.

While certain embodiments have been described these embodiments have been presented by way of example only, and are not intended to limit the scope of the invention. Indeed, the novel embodiments described herein may be embodied in a variety of other forms. Furthermore, various omissions, substitutions and changes in the form of the embodiments described herein may be made without departing from the spirit of the invention. The accompanying claims and there equivalents are intended to cover such forms or modifications as would fall within the scope and spirit of the invention.

What is claimed is:

1. A fixing apparatus, comprising:

a fixing belt including a conductive layer; and an induced current generation section facing the fixing belt, comprising a coil configured to generate a magnetic flux, and a magnetic body facing the fixing belt across the coil, wherein a part of the magnetic body facing an end in a width direction of the fixing belt is set as a movable magnetic body capable of moving in a width direction; and wherein the movable magnetic body includes a plurality of movable magnetic bodies provided at ends in the width direction of the magnetic body, and wherein pressing members configured to press the movable magnetic bodies positioned at the ends in the width direction of the magnetic body to move the movable magnetic bodies inward in the width direction are provided at an outside portion in the width direction of the magnetic body.

2. The fixing apparatus according to claim 1, wherein the magnetic body is divided into a plurality of unit magnetic bodies arranged in the width direction, and the plurality of unit magnetic bodies contains the plurality of movable magnetic bodies.

3. The fixing apparatus according to claim 1, wherein the movable magnetic bodies and the pressing members are provided at both sides in the width direction of the magnetic body.

4. The fixing apparatus according to claim 1, wherein the magnetic body is divided into a plurality of unit magnetic bodies arranged in the width direction, the plurality of unit magnetic bodies contains the plurality of movable magnetic bodies, the fixing apparatus further comprises a return member configured to return the plurality of movable magnetic bodies from a first position after moving to an inside in the width direction to a second position before movement, and the return member is configured to approach or separate from the magnetic body in a direction crossing the width direction, and includes teeth inserted at positions between adjacent movable magnetic bodies at the inside in the width direction of the plurality of movable magnetic bodies to return the plurality of movable magnetic bodies to the second position before movement at the time of approaching the magnetic body.

5. The fixing apparatus according to claim 1, wherein the magnetic body is divided into a plurality of unit magnetic bodies arranged in the width direction, the plurality of unit magnetic bodies contains the plurality of movable magnetic bodies, and energization members to energize the plurality of movable magnetic bodies outwardly in the width direction are provided at positions between adjacent movable magnetic bodies at the inside in the width direction of the plurality of movable magnetic bodies.

6. The fixing apparatus according to claim 5, wherein a plurality of the energization members is arranged in the width direction, and the plurality of the energization members generates different energizing forces in accordance with their respective positions in the width direction of the magnetic body.

7. The fixing apparatus according to claim 1, further comprising:

a magnetic body moving controller configured to control movement of the movable magnetic body, wherein the magnetic body moving controller is configured to move the movable magnetic body according to a size of sheet conveyed by the fixing belt.

8. The fixing apparatus according to claim 1, further comprising:

a magnetic body moving controller configured to control movement of the movable magnetic body, and a temperature sensor configured to detect a temperature of an end portion in the width direction of the fixing belt, wherein the magnetic body moving controller is configured to move the movable magnetic body responsive to detected temperature information from the temperature sensor.

9. The fixing apparatus according to claim 8, further comprising:

another temperature sensor configured to detect a temperature of a central portion of the fixing belt in the width direction, wherein the magnetic body moving controller is configured to control a heating control circuit of the fixing belt based on at least temperature information received from the temperature sensors.

10. An image forming apparatus, comprising:

an image forming section configured to form an image on a sheet; and a fixing apparatus to fix the image on the sheet, the fixing apparatus comprising a fixing belt including a conductive layer; and an induced current generation section facing the fixing belt, the induced current generation section including a coil configured to generate a magnetic flux and a magnetic body facing the fixing belt across the coil, wherein a part of the magnetic body facing an end in a width direction of the fixing belt is set as a movable magnetic body configured to move in a width direction, and wherein the image forming apparatus further includes pressing members configured to press the movable magnetic body so as to effectuate inward movement of the movable magnetic body in the width direction.

11. The image forming apparatus according to claim 10, wherein the coil is arranged with the fixing belt such that magnetic flux generated by the coil is concentrated on the fixing belt.

12. The image forming apparatus according to claim 10, further comprising:

at least one energization member configured to generate an energizing force to act on the movable magnetic body.

13. A fixing method, comprising:

arranging a fixing belt having a conductive layer so as to face an induced current generation section of a fixing apparatus;

generating a magnetic flux using a coil provided in the induced current generation section;

disposing a magnetic body so as to face the fixing belt across from the coil;

positioning at least a portion of the magnetic body so as to face an end portion of the fixing belt in a width direction;

causing at least the portion of the magnetic body to move in the width direction;

dividing the magnetic body into a plurality of unit magnetic bodies arranged in the width direction, the plurality of unit magnetic bodies containing a plurality of movable magnetic bodies;

providing the movable magnetic bodies at end portions of the magnetic body in the width direction, and pressing the movable magnetic bodies to move the movable magnetic bodies inward in the width direction.

14. The fixing method according to claim 13, wherein the movable magnetic bodies and the pressing members are provided at both sides in the width direction of the magnetic body.

15. The fixing method according to claim 13, further comprising:

returning the plurality of movable magnetic bodies from a first position after movement in the width direction to a second position before movement, and inserting teeth between adjacent movable magnetic bodies along the width direction of the plurality of movable magnetic bodies.

16. The fixing method according to claim 13, further comprising:

energizing the plurality of movable magnetic bodies via energizing members disposed at positions between adjacent movable magnetic bodies at the inside in the width direction of the plurality of movable magnetic bodies.

* * * * *